US009309022B2

(12) United States Patent
Nash et al.

(10) Patent No.: US 9,309,022 B2
(45) Date of Patent: Apr. 12, 2016

(54) PACKAGE FOR A MEDICAL DEVICE

(71) Applicant: Medtronic Vascular, Inc., Santa Rosa, CA (US)

(72) Inventors: Stephen Nash, Oranmore County (IE); David Clarke, Galway (IE)

(73) Assignee: Medtronic Vascular, Inc., Santa Rosa, CA (US)

( * ) Notice: Subject to any disclaimer, the term of this patent is extended or adjusted under 35 U.S.C. 154(b) by 0 days.

(21) Appl. No.: 14/479,054

(22) Filed: Sep. 5, 2014

(65) Prior Publication Data

US 2015/0251798 A1 Sep. 10, 2015

Related U.S. Application Data

(63) Continuation-in-part of application No. 29/484,142, filed on Mar. 6, 2014, now Pat. No. Des. 724,938, and a continuation-in-part of application No. 29/484,143, filed on Mar. 6, 2014, now Pat. No. Des. 732,383, and a continuation-in-part of application No. 29/484,145, filed on Mar. 6, 2014, now Pat. No. Des. 724,427.

(51) Int. Cl.
*B65D 5/02* (2006.01)
*B65D 5/42* (2006.01)

(52) U.S. Cl.
CPC ..... *B65D 5/4208* (2013.01); *B65D 5/029* (2013.01); *B65D 5/0245* (2013.01)

(58) Field of Classification Search
CPC ..... B65D 5/4208; B65D 5/0245; B65D 5/029
USPC ..... 229/109, 110; 206/815
See application file for complete search history.

(56) References Cited

U.S. PATENT DOCUMENTS

| | | | | | |
|---|---|---|---|---|---|
| 1,888,818 | A * | 11/1932 | Daller | B65D 5/5435 | 206/807 |
| 2,730,290 | A | 1/1956 | Lynes | | |
| 3,133,688 | A | 5/1964 | Asman | | |
| 3,512,697 | A * | 5/1970 | Robinson | B65D 5/10 | 206/424 |
| 3,923,234 | A * | 12/1975 | Lund, Jr. | B65D 5/02 | 206/424 |
| 4,657,174 | A | 4/1987 | Hennig | | |
| 5,000,374 | A | 3/1991 | Deiger | | |
| 5,248,037 | A * | 9/1993 | Kornberg | B65D 77/006 | 206/457 |
| 5,560,539 | A * | 10/1996 | Baxter | B65D 5/0227 | 229/109 |
| 6,112,978 | A * | 9/2000 | Barr | B65D 5/48014 | 206/461 |
| 6,394,742 | B1 * | 5/2002 | Buscema | B65D 5/001 | 229/143 |
| 2002/0053592 | A1 | 5/2002 | Urtubey | | |

FOREIGN PATENT DOCUMENTS

| | | |
|---|---|---|
| EP | 0359968 | 8/1989 |
| EP | 1331170 | 7/2003 |
| KR | 30-0433447 | 12/2006 |

OTHER PUBLICATIONS

PCT/US2014/054397, "The International Search Report and the Written Opinion of the International Searching Authority" mailed Dec. 2, 2014.

* cited by examiner

*Primary Examiner* — Gary Elkins

(57) ABSTRACT

A package includes a box having an interior volume and a first pocket disposed at a first corner of the box. The first pocket includes a lip configured for a finger of a user to be inserted therein for removal of the package from a storage unit.

21 Claims, 12 Drawing Sheets

PACKAGE FOR A MEDICAL DEVICE

CROSS-REFERENCE TO RELATED APPLICATIONS

This application is a Continuation-in-Part of U.S. application Ser. Nos. 29/484,142; 29/484,143; and 29/484,145, each of which was filed on Mar. 6, 2014, and each of which is incorporated by reference herein in its entirety.

FIELD OF THE INVENTION

Embodiments hereof relate to a package for a medical device, and in particular, to a package including a corner pocket for ease of removal of the package from a shelf.

BACKGROUND OF THE INVENTION

Packages, such as packages for medicals devices, are often stacked side-by-side or on top of each other on shelving units or other storage units. In order to maximize space, the height between shelves is often approximately the same size as the height of the packages. Further, packages are often tightly packed or bunched next to each other to maximize the number of packages that can be stored per unit length of the shelving unit. With packages tightly packed on shelving units, it can be difficult to remove a particular package from the group.

Accordingly, it would be desirable for a package to include a feature which allows a selected package to be easily removed from among packages crowded onto a shelving unit.

BRIEF SUMMARY OF THE INVENTION

Embodiments hereof are related to a package including a box having an interior volume and a first pocket disposed at a first corner of the box. The first pocket includes a lip configured for a finger of a user to be inserted therein for removal of the package from a storage unit. The box may be defined by a first panel, second panel opposite the first panel such that an interior surface of the first panel faces an interior surface of the second panel, and a top edge panel, a bottom edge panel, a front edge panel, and a rear edge panel each extends between the first panel and the second panel. The first pocket may be defined by a first surface extending from the top edge panel to the front edge panel, the interior surface of the first panel, the interior surface of the second panel, and the interior surface of the front edge panel. The first lip of the first pocket may be formed by the first surface contacting the front edge panel at a first location remote from a first edge of the front edge panel closest to the top edge panel, thereby forming the first lip on the front edge panel between the first edge of the front edge panel and the first location. The package may also include a second pocket disposed at a second corner of the box.

Embodiments hereof are also related to a single blank sheet of material for making a package. The sheet includes a first panel and a second panel coupled to each other by a bottom edge panel, a fold line disposed between the first panel and the bottom edge panel, and another second fold line disposed between the bottom edge panel and the second panel. A top edge panel is coupled to the first edge panel along another fold line. A rear edge panel is coupled to the first panel along another fold line. A front edge panel coupled to the first panel along another fold line. A first pocket panel is coupled to the front edge panel along another fold line and to the first panel along another fold line. The sheet is configured to fold along the fold lines such that an interior surface of the first panel faces an interior surface of the second panel, the front edge panel, the top edge panel, the rear edge panel and the front edge panel each extends between the first panel and the second panel, and the first pocket panel folds between the interior surface of the first panel and the interior surface of the second panel to form a first pocket with a first lip defined by a portion of the front edge panel adjacent the top edge panel.

The sheet may also include a second pocket panel coupled to the bottom edge panel the first panel, and the second panel along corresponding fold lines such that when the sheet folds along the fold lines, the second pocket panel folds between the interior surface of the first panel and the interior surface of the second panel to form a second pocket with a second lip defined by a portion of the front edge panel adjacent the bottom edge panel.

The sheet may also include tabs coupled to the top edge panel, rear edge panel, and the font edge panel along corresponding fold lines such that when the sheet is folded along the fold lines, the tabs extend along the interior surface of the second panel.

BRIEF DESCRIPTION OF DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Specific embodiments of the present invention are now described with reference to the figures, wherein like reference numbers indicate identical or functionally similar elements.

The following detailed description is merely exemplary in nature and is not intended to limit the invention or the application and uses of the invention. Although the description of the invention is in the context of a package for a medical device, the invention may also be used in packaging for other products. Furthermore, there is no intention to be bound by any expressed or implied theory presented in the preceding technical field, background, brief summary or the following detailed description.

Figure 1:
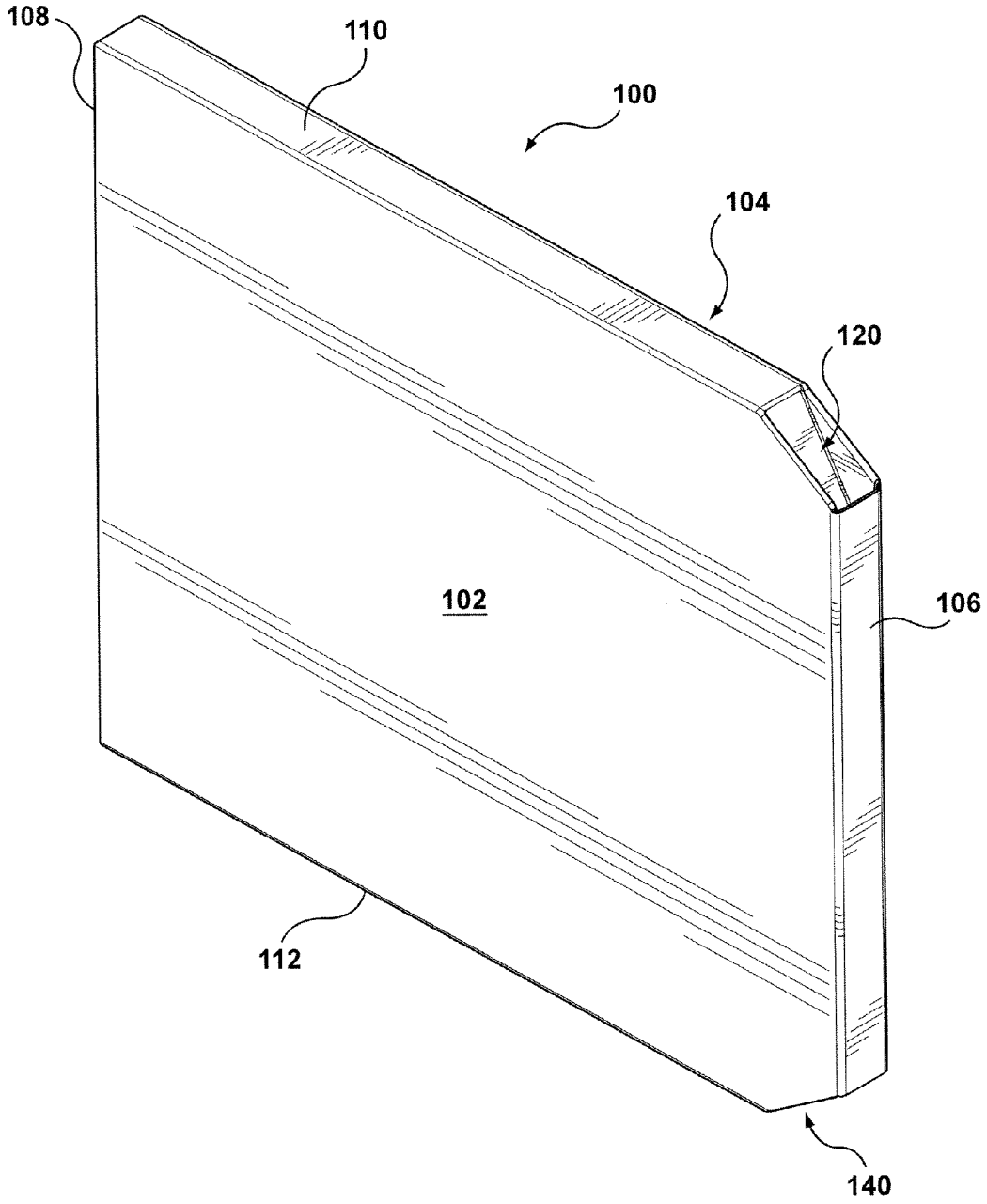
FIG. 1 is a schematic perspective view of a package according to an embodiment hereof.

FIGS. 1-10 shows an embodiment of a container or carton or package 100 according to an embodiment hereof. Package 100 may be made of any material suitable for packaging products such as medical devices. For example, and not by way of limitation, package 100 may be made from solid bleach sulfate carton, cardboard, and other similar materials. Package 100 as shown in FIG. 1 is generally shaped as a box with an interior volume and includes a first corner pocket 120 and a second corner pocket 140. First and second corner pockets 120, 140 are finger pockets by which a user may easily remove package 100 from a shelf or other storage unit. Further, although two (2) corner pockets are shown and described herein, it is recognized that a package with only a single corner pocket, or more than two (2) corner pockets, may be utilized.

Package 100 includes a first or left panel 102, a second or right panel 104, a front edge panel 106, a rear edge panel 108, a top edge panel 110, and a bottom edge panel 112. Although directional descriptions such as "left", "right", "front", "rear", "top", and "bottom" have been used to describe the panels of package 100, these descriptions are merely used for reference to describe package 100 as it may be placed on a shelf with front edge panel 106 facing outwardly and a user facing front edge panel 106. However, these directional descriptions do not limit package 100 as it may be oriented in other directions in space.

Figure 2:
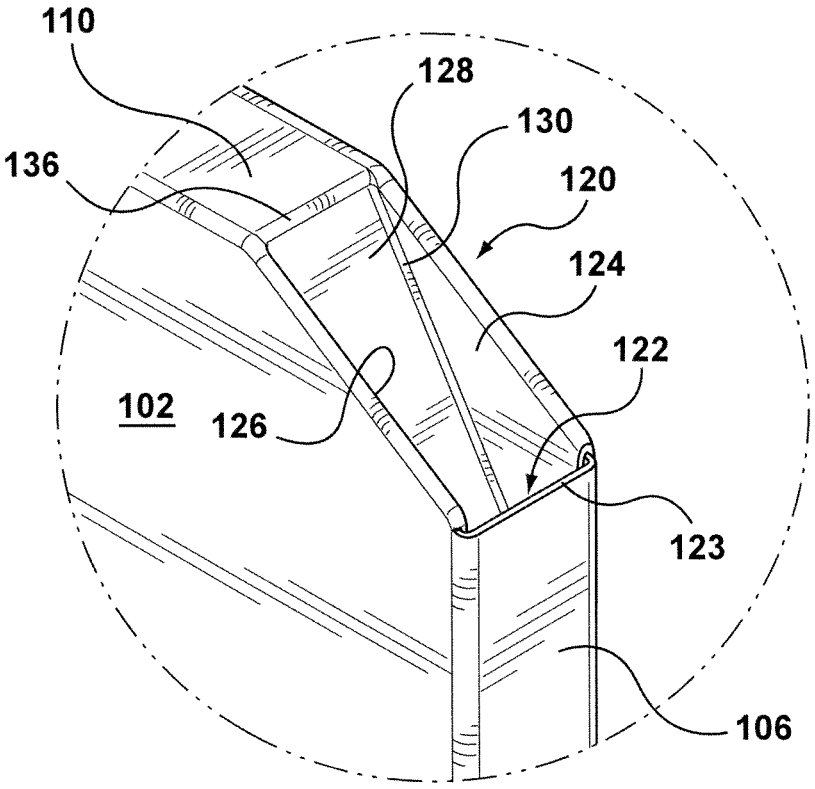
FIG. 2 is an enlarged view of a corner pocket of the package of FIG. 1.
Figure 3:
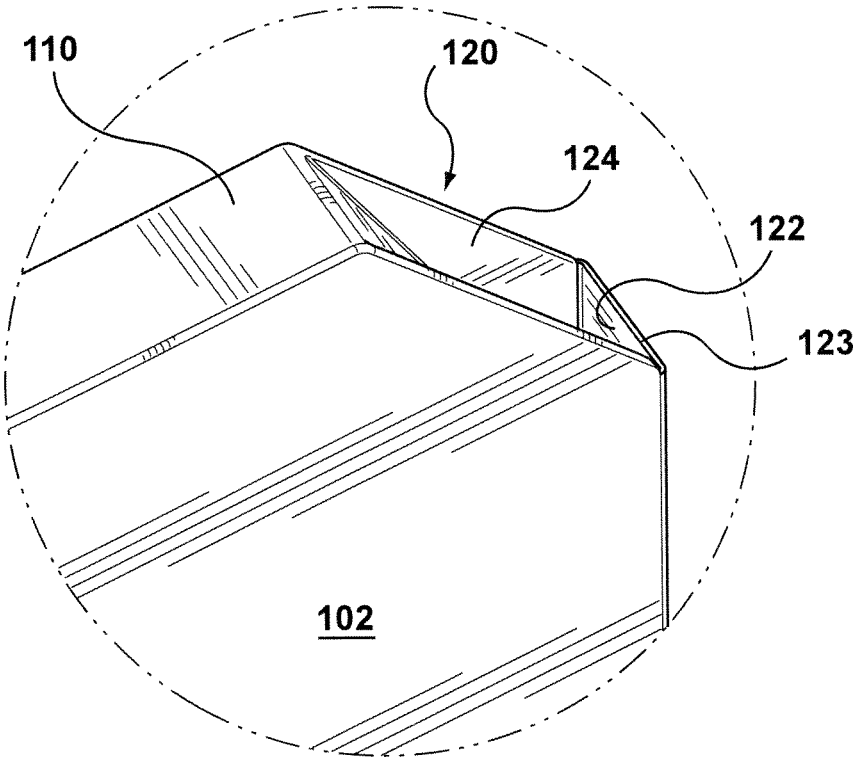
FIG. 3 is a view of the corner pocket of FIG. 2 from a different perspective.

First corner pocket 120 is formed as a chamfered corner between front edge panel 106 and top edge panel 110. First corner pocket 120 is not merely a chamfered corner, as it includes a depth to form a pocket. As can be seen in FIGS. 1-3, first corner pocket 120 includes a lip 122, a first side surface 124, a second side surface 126, and an angled surface 128. Lip 122 is formed by angled surface 128 contacting front edge panel 106 at a location remote from a top edge 123 of front edge panel 106.

Figure 4:
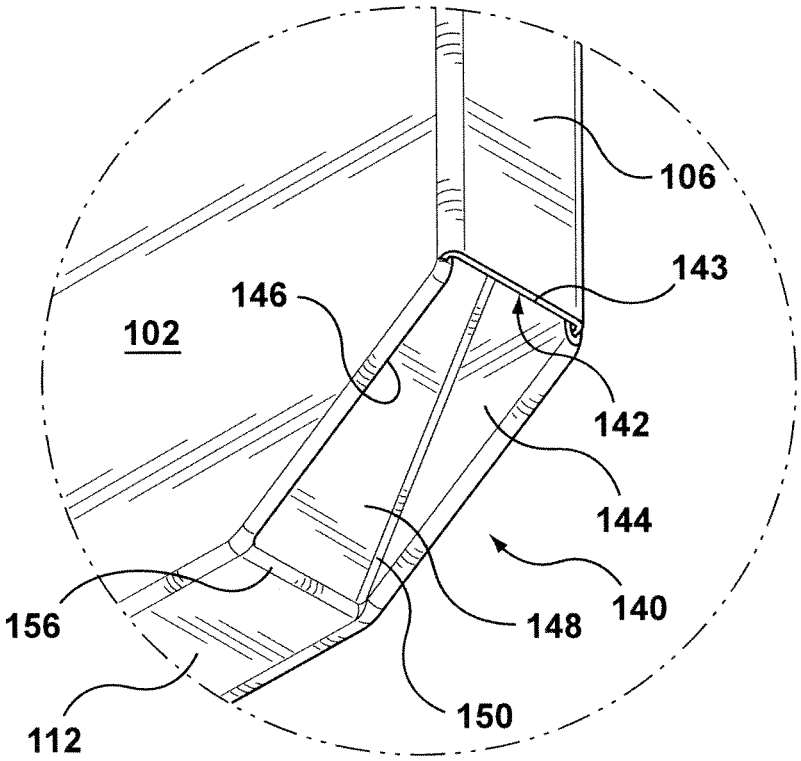
FIG. 4 is an enlarged view of another corner pocket of the package of FIG. 1.
Figure 5:
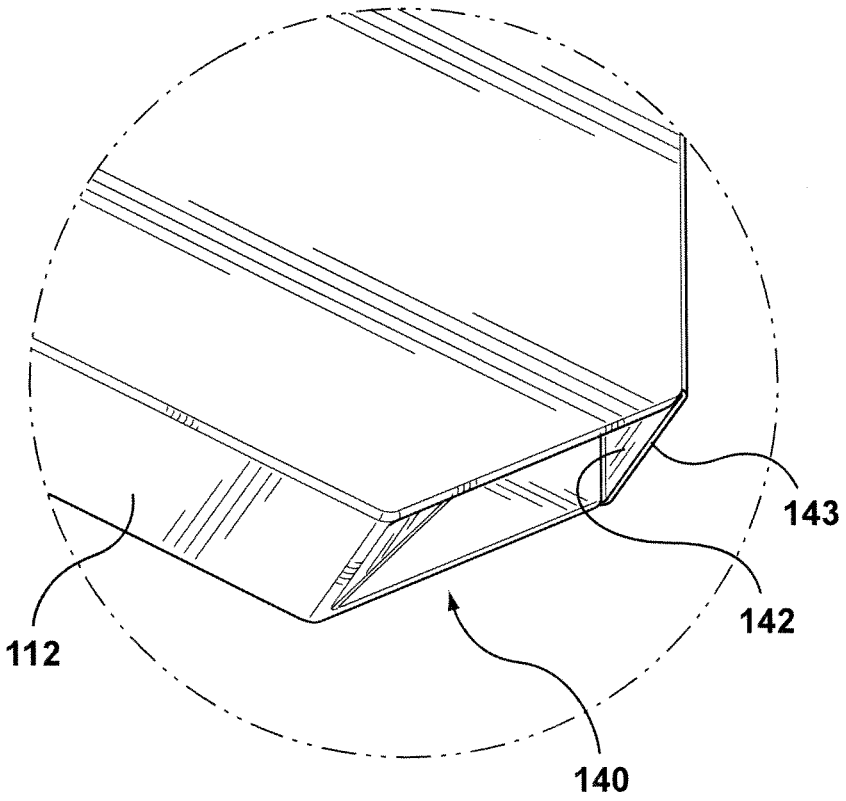
FIG. 5 is a view of the corner pocket of FIG. 4 from a different perspective.

Similarly, second corner pocket 140 is formed as a chamfered corner between front edge panel 106 and bottom edge panel 112. As with first corner pocket 120, second corner pocket 140 has a depth to form a pocket. As can be seen in FIGS. 1 and 4-5, second corner pocket 140 includes a lip 142, a first side surface 144, a second side surface 146, and an angled surface 148. Lip 142 is formed by angled surface 148 contacting front edge panel 106 at a location remote from a bottom edge 143 of front edge panel 106.

Figure 6:
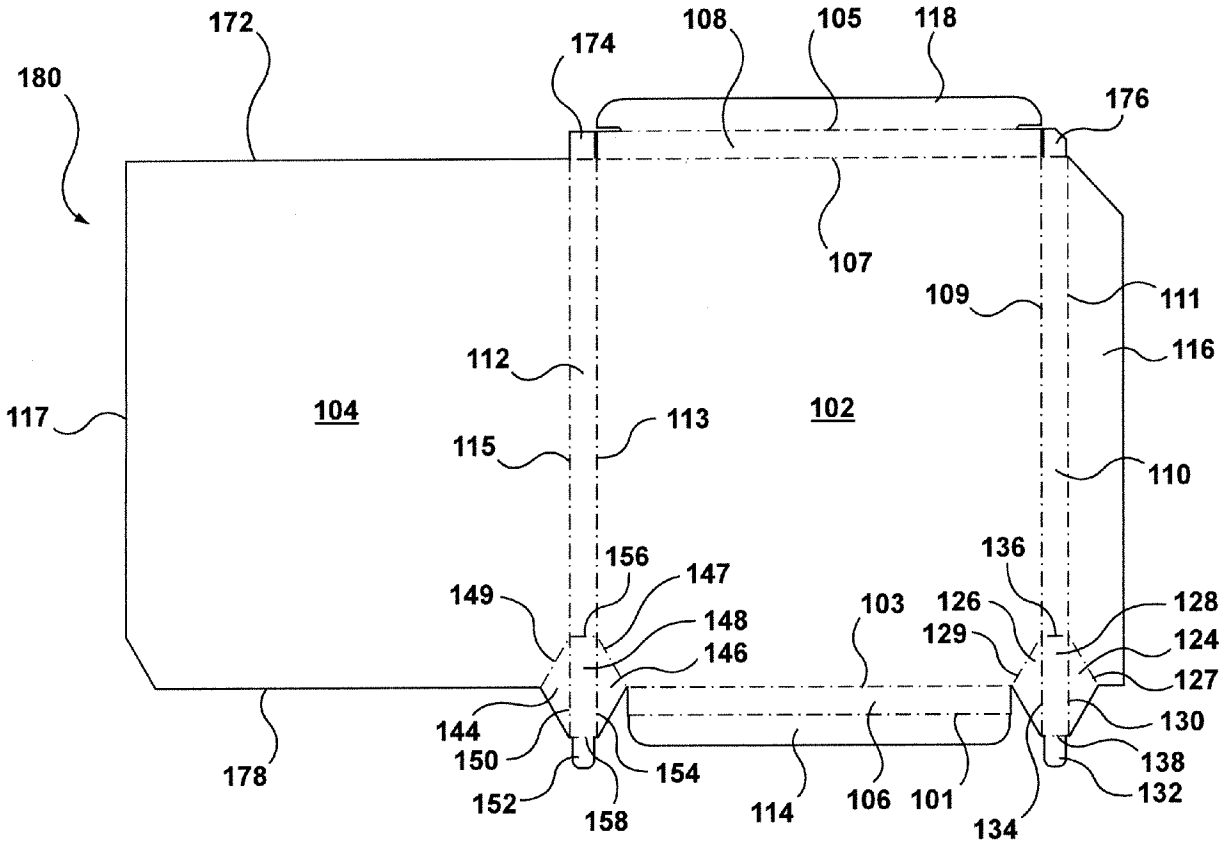
FIG. 6 shows a blank sheet of laminar material, such as cardboard, used to make the package of FIGS. 1-5.

FIG. 6 shows a blank sheet of laminar material 180, such as solid bleach sulfate carton, cardboard, and other similar materials, used to make the package of FIGS. 1-5. FIG. 6 shows the panels and surfaces described above with respect to FIGS. 1-5 and fold lines where blank sheet of material 180 is folded as described below to form package 100. As described below, left panel 102 and right panel 104 as shown in FIG. 6 are considered the outer or exterior surfaces thereof. Thus, the directions of the folds in the description below are such that the surfaces shown in FIG. 6 are outer or exterior surfaces of package 100. The folds can equally be in the opposite direction such that the surfaces shown in FIG. 6 are inner or interior surfaces of package 100.

In particular, sheet 180 is folded approximately 90 degrees along fold line 113 between left panel 102 and bottom edge panel 112 such that left panel 102 and bottom edge panel 112 are approximately perpendicular to each other. Sheet 180 is also folded approximately 90 degrees along fold line 115 between bottom edge panel 112 and right panel 104 such that bottom edge panel 112 and right panel 104 are approximately perpendicular to each other. Folding sheet 180 along fold lines 113 and 115 as described above causes an inner surface of left panel 102 to face an inner surface of right panel 104, separated from each other by approximately the width of bottom edge surface 112. The term "approximately 90 degrees" as used herein means approximately 90 degrees such that the panels described herein form the general shape of a box and allows for minor variations from 90 degrees provided that the package formed from folding sheet 180 forms such a box.

Sheet 180 is also folded approximately 90 degrees along a fold line 107 between left panel 102 and rear edge panel 108 such the rear edge panel 108 extends from left panel 102 towards right panel 104. Sheet 180 is also folded along a fold line 105 between rear edge panel 108 and a tab 118. As right panel 102 and left panel 104 are folded towards each other, tab 118 is tucked inside a rear edge 172 of right panel 104 such that tab 118 extends along the inner surface of right panel 104 between a corner tab 174 and a corner tab 176.

Similarly, sheet 180 is also folded approximately 90 degrees along a fold line 109 between left panel 102 and top edge panel 110 such the top edge panel 110 extends from left panel 102 towards right panel 104. Sheet 180 is also folded along a fold line 111 between top edge panel 110 and a tab 116. As left panel 102 and right panel 104 are folded towards each other, tab 116 is tucked inside a top edge 117 of right panel 104 such that tab 116 extends along the inner surface of right panel 104 between a corner 176 and first pocket 120 associated with a fold line 136. Tab 116 is attached to the interior surface of right panel 104. Tab 116 may be adhesively attached to the interior surface of right panel 104 or attached in other ways. The adhesive used to adhesively attach tab 116 to the interior surface of right panel 104 may be any adhesive. For example and not by way of limitation, adhesive product number 2171 or 2174 available from The Adhesive Products Inc. may be utilized.

Sheet 180 is also folded approximately 90 degrees along a fold line 103 between left panel 102 and front edge panel 106 such front edge panel 106 extends from left panel 102 towards right panel 104. Sheet 180 is also folded along a fold line 101 between front edge panel 106 and a tab 114. As left panel 102 and right panel 104 are folded towards each other, tab 114 is tucked inside a front edge 178 of right panel 104 such that tab 114 extends along the inner surface of right panel 104 between first pocket 120 associated with a fold line 136 and second pocket 140 associated with a fold line 156. Further, pockets 120 and 140 are formed as sheet 180 is folded as described above, and as described in more detail below.

Figure 7:
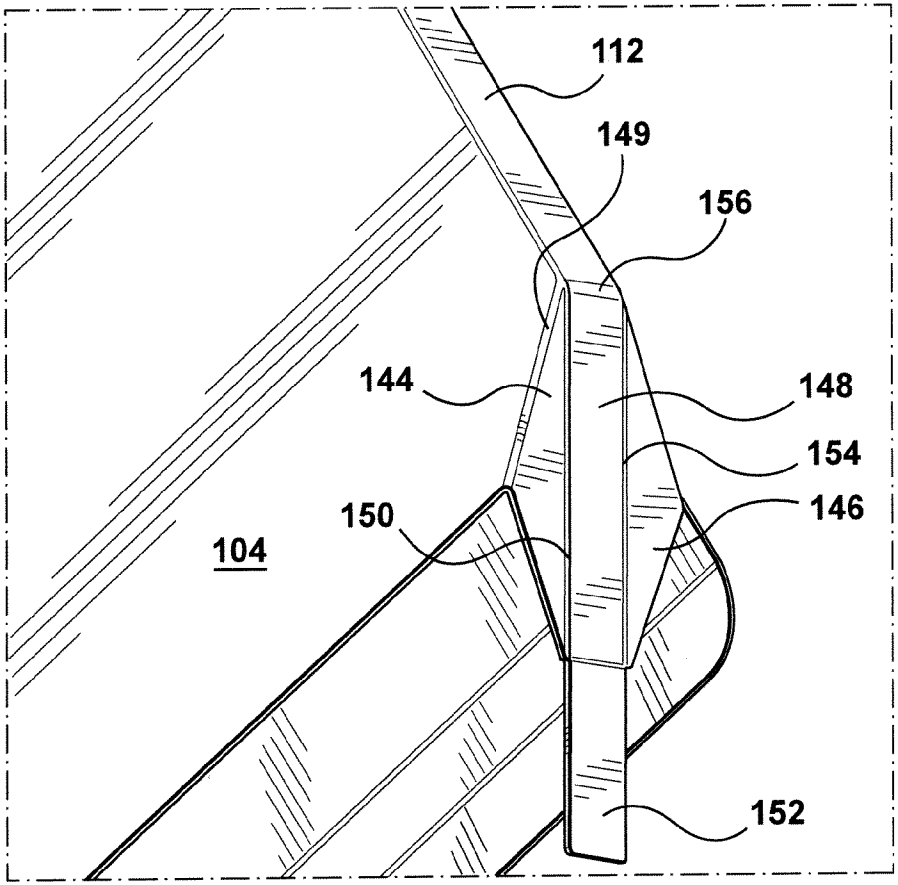
FIG. 7 is a schematic illustration of a step of forming the corner pocket of FIG. 3
Figure 8:
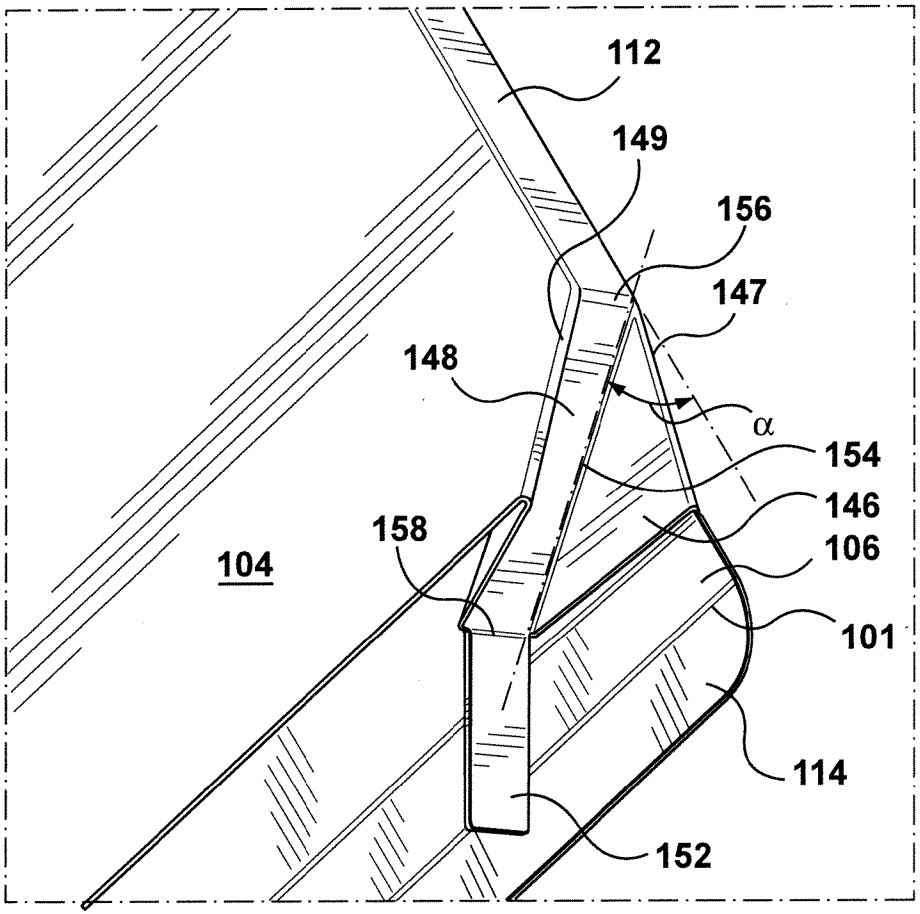
FIG. 8 is a schematic illustration of another step of forming the corner pocket of FIG. 3.
Figure 9:
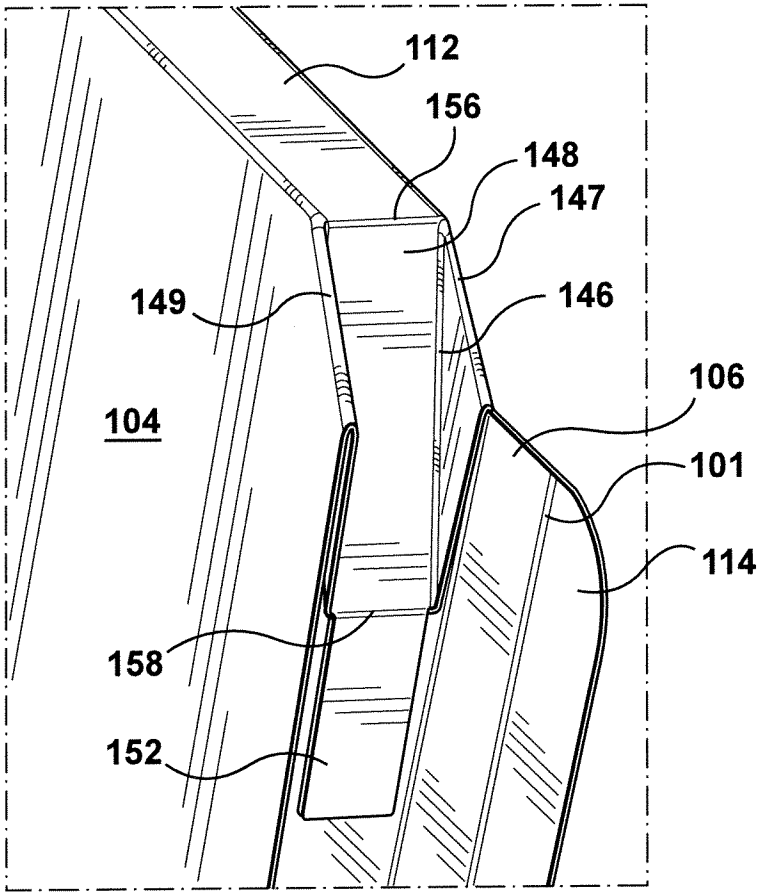
FIG. 9 is a schematic illustration of another step of forming the corner pocket of FIG. 3.

In particular, FIGS. 7-9 shows pocket 140 being formed. Although pocket 140 is being shown, pocket 120 is formed in a similar manner. As shown in FIG. 7, as (or after) left panel 102 and right panel 104 are folded towards each other, a tab 152 is pulled out of plane with bottom edge panel 112 and bent along a fold line 156 to form angled surface 148 extending at an angle $\alpha$ relative to bottom edge panel 112. Angle $\alpha$ may be in the range of 30 to 60 degrees as defined in FIG. 8. Sheet 180 also folds along a fold line 147 between second side surface 146 and front panel 102 and along a fold line 149 between first side surface 144 and rear panel 104.

As shown in FIGS. 8-9, tab 152 is pushed towards an interior volume of package 100 such that second pocket 140 folds along a fold line 154 between second side surface 146 and angled surface 148 such that second side surface 146 is pushed against the inner surface of left panel 102. Similarly, second pocket 140 folds along a fold line 150 between first side surface 144 and angled surface 148 such that first side surface 144 is pushed against the inner surface of right panel 104. Tab 152 may be folded along fold line 158 to extend towards first pocket 120 along the inside surface of front edge panel 106. Alternatively, tab 152 may be folded in the opposite direction along fold line 158 to create a double-thickness with front edge panel 106 for at least a portion of the front edge of second pocket 140 at lip 142.

First pocket 120 is formed in a similar way as described above with respect to second pocket 140. Accordingly, sheet 180 as shown in FIG. 6 includes a fold line 136 between top edge panel 110 and angled surface 128, a fold line 127 between first side surface 124 of first pocket 120 and tab 116, a fold line 129 between second side surface 126 and front panel 102, a fold line 130 between angled surface 128 and first side surface 124, a fold line 134 between angled surface 128 and second side surface 126, and a fold line 138 between angled surface 148 and tab 132.

Then, front edge panel 106 is folded along fold line 103 such that front edge panel 106 extends towards right panel 104 and tab 114 is tucked inside front edge 178 of right panel 104. A portion of tab 114 adjacent first pocket 120 is tucked between a portion of first side surface 124 of pocket 120 and the inner surface of right panel 104. Similarly, a portion of tab 114 adjacent second pocket 140 is tucked between a portion of first side surface 144 of second pocket 140 and the inner surface of right panel 104.

Figure 11:
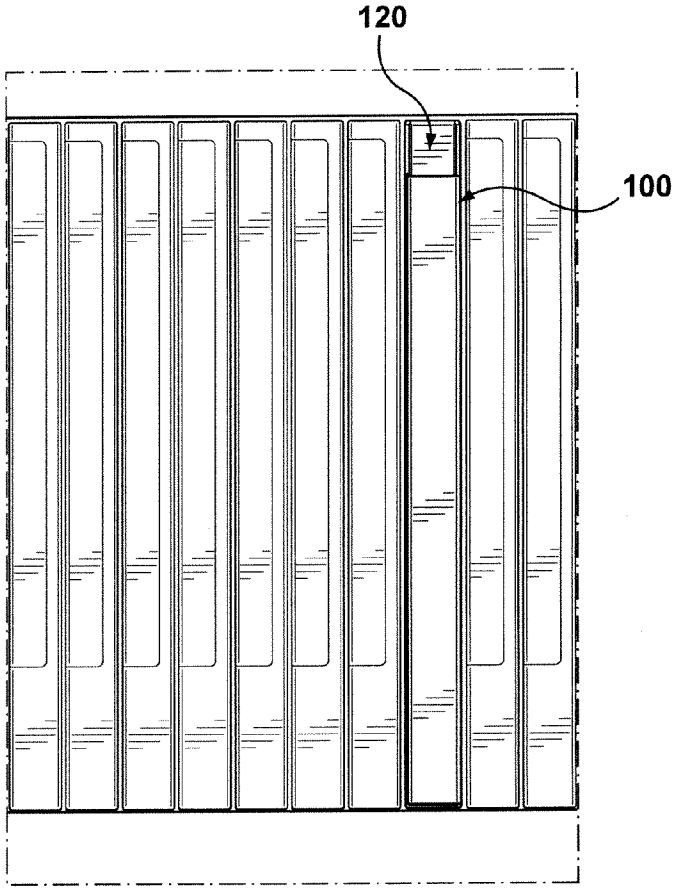
FIGS. 11-13 show accessing and removing from a shelving unit the package of FIG. 1 with only a single pocket.
Figure 10:
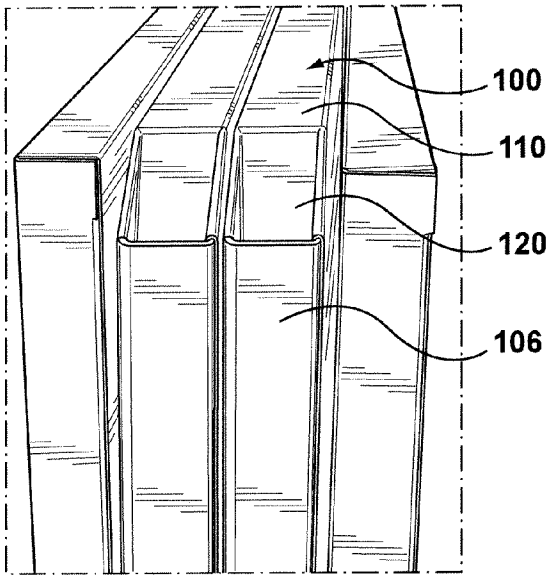
FIG. 10 is an illustration of the package of FIG. 1 adjacent conventional packages.
Figure 13:
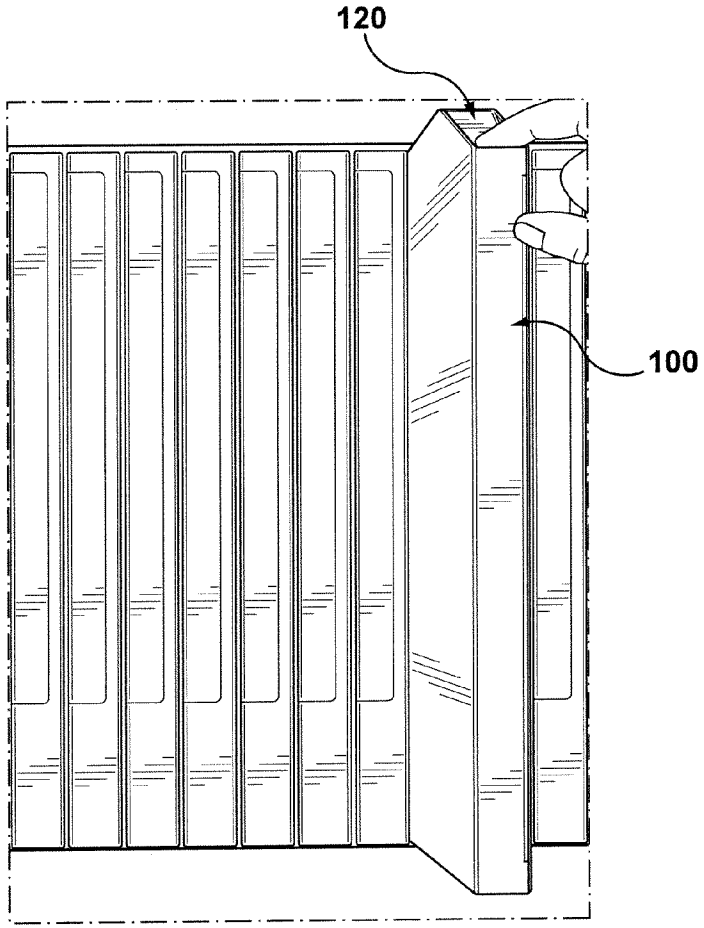
Figure 12:
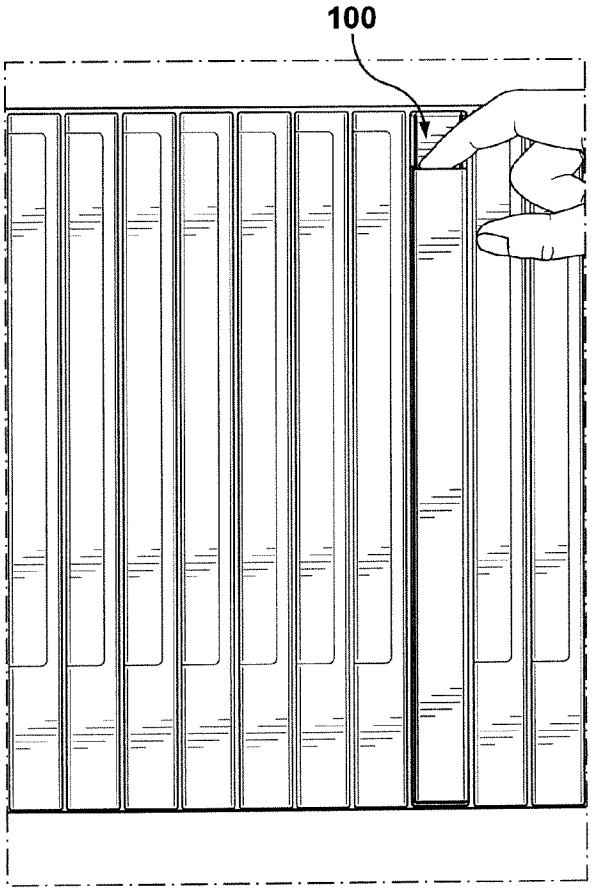
Figure 14:
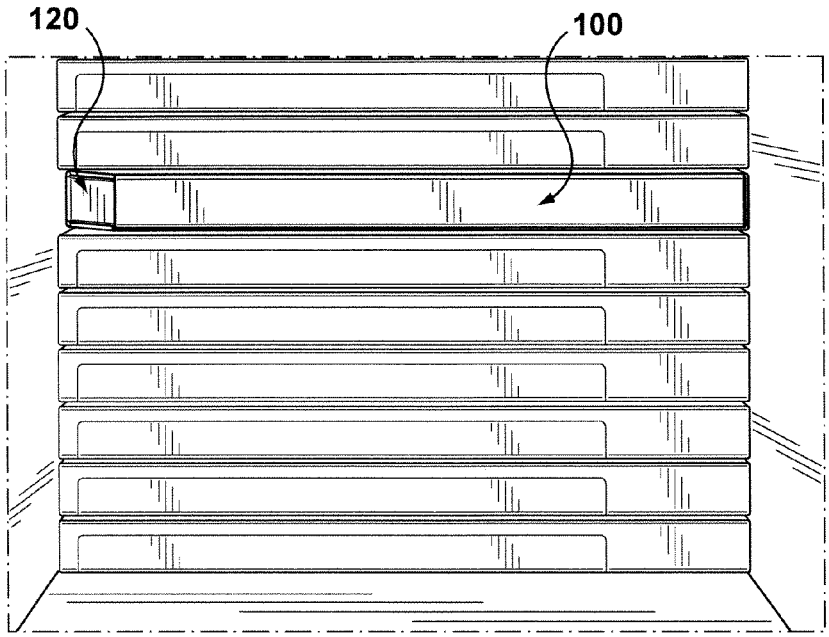
FIGS. 14-15 show accessing and removing from a shelving unit the package of FIG. 1 with only a single pocket with the packages on the shelving unit stacked horizontally.
Figure 15:
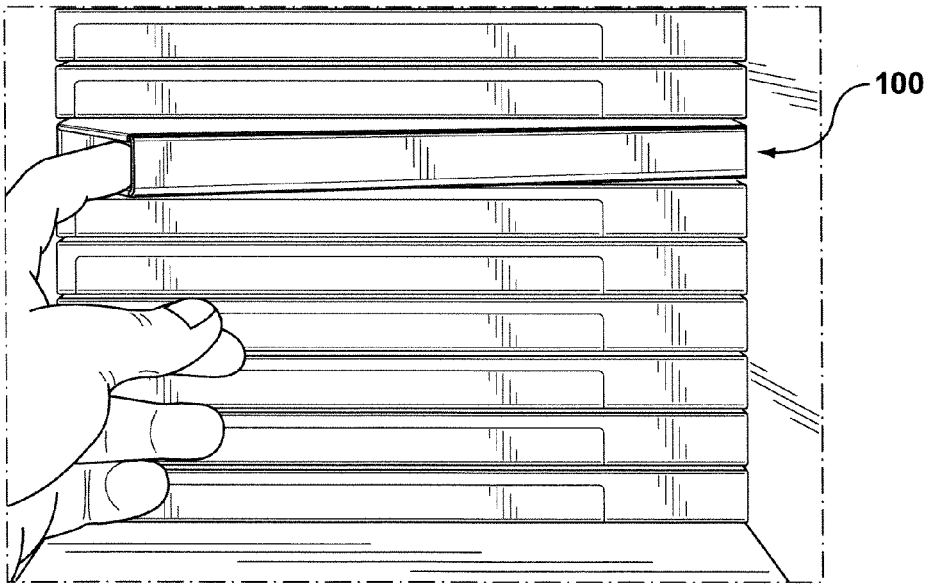

FIG. 10 shows two packages 100 adjacent conventional packages. FIG. 11 shows a package 100 with a single pocket 120 instead of two pockets, and located on a shelf adjacent to conventional packages. As can be seen in FIG. 11, it can be difficult to remove a conventional package from a packed or full shelf because it is difficult to access a surface to grab or upon which to pull. The large panels of the conventional packages (i.e., left and right panels) are blocked by adjacent packages. The top and bottom panels are blocked by the shelf. A package according to the present application, on the other hand, allows a user to insert a finger into pocket 120 and slide or tilt package 100 out of the shelving unit, as shown in FIGS. 12-13. Similarly, if the packages are stacked horizontally, as shown in FIGS. 14-15, a user can access pocket 120 to easily remove package 100 from the shelf.

While various embodiments according to the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment.

What is claimed is:

1. A package comprising:

a box having an interior volume, the box being defined by a first panel, a second panel opposite the first panel such that an interior surface of the first panel faces an interior surface of the second panel, and wherein the box is further defined by four edge panels extending between the first panel and the second panel;

a first pocket disposed at a first corner of the box between two of the four edge panels, wherein the first pocket includes a lip defined along one of the two edge panels of the first corner, wherein the first pocket includes a first pocket tab that forms an angled surface extending from a first edge panel of the two edge panels to an interior surface of a second edge panel of the two edge panels, wherein the first pocket tab includes a tab fold where the first pocket tab is folded such that a portion of the first pocket tab extends along the interior surface of the second edge panel such that a double-thickness is formed with the second edge panel for at least a portion of the lip, wherein the first pocket is configured for a finger of a user to be inserted therein for removal of the package from a storage unit.

2. The package of claim 1, wherein the four edge panels comprise a front edge panel, a rear edge panel, a top edge panel, and a bottom edge panel.

3. The package of claim 1, wherein the first pocket is further defined by a first side surface and a second side surface adjacent to and on opposite sides of the angled surface, the first side surface extending from the interior surface of the first panel to the angled surface and the second side surface extending from the interior surface of the second panel to the angled surface.

4. The package of claim 3, wherein the angled surface extending from the first edge panel to the second edge panel contacts the interior surface of the second edge panel at a location remote from an edge of the second edge panel closest to the first edge panel, thereby forming the lip on the second edge panel extending between the edge of the second edge panel closest to the first edge panel and the remote location.

5. The package of claim 3, wherein the first side surface of the first pocket is disposed adjacent the interior surface of the first panel and the second side surface of the first pocket is disposed adjacent the interior surface of the second panel.

6. The package of claim 2, further comprising a second pocket at a second corner of the box, wherein the second pocket includes a lip and the second pocket is configured for a finger of a user to be inserted therein for removal of the package from a storage unit.

7. The package of claim 6, wherein the first pocket is formed between the front edge panel and the top edge panel and wherein the second pocket is formed between the front edge panel and the bottom edge panel.

8. The package of claim 7, wherein the first pocket is defined by a first surface extending from the top edge panel to the interior surface of the front edge panel, and extending from the interior surface of the first panel to the interior surface of the second panel, the first surface including the angled surface.

9. The package of claim 8, wherein the second pocket is defined by a second surface extending from the bottom edge panel to the interior surface of the front edge panel, and extending from the interior surface of the first panel to the interior surface of the second panel.

10. The package of claim 9, wherein the first surface contacts the front edge panel at a first location remote from a first edge of the front edge panel closest to the top edge panel, thereby forming the lip of the first pocket on the front edge panel between the first edge of the front edge panel and the first location.

11. The package of claim 9, wherein the second surface contacts the front edge panel at a second location remote from a second edge of the front edge panel closest to the bottom edge panel, thereby forming the lip of the second pocket on the front edge panel between the second edge of the front edge panel and the second location.

12. A single blank sheet of material for forming a package, the blank sheet of material comprising:

a first panel and a second panel coupled to each other by a bottom edge panel;

a first fold line disposed between the first panel and the bottom edge panel;

a second fold line disposed between the bottom edge panel and the second panel;

a top edge panel coupled to the first edge panel along a third fold line;

a rear edge panel coupled to the first panel along a fourth fold line;

a front edge panel coupled to the first panel along a fifth fold line; and a first pocket panel coupled to the top edge panel along a sixth fold line and to the first panel along a seventh fold line, wherein the sheet is configured to fold along the fold lines such that an interior surface of the first panel faces an interior surface of the second panel, the front edge panel, the top edge panel, the rear edge panel and the bottom edge panel each extends between the first panel and the second panel, and the first pocket panel folds between the interior surface of the first panel and the interior surface of the second panel to form a first pocket with a first lip defined by a portion of the front edge panel adjacent the top edge panel, wherein the first pocket panel includes a first pocket tab with a first tab fold line, wherein the first pocket tab is configured to fold along the sixth fold line such that a first portion of the first pocket tab forms an angled surface from the top edge to an interior surface of the front edge panel, and wherein the first pocket tab is configured to fold along the first tab fold line such that a second portion of the first pocket tab extends along the interior surface of the front edge panel back towards the top edge panel and parallel with the lip such that a double-thickness is formed with the front edge panel for at least a portion of the lip.

13. The blank sheet of material of claim 12, further comprising:

a second pocket panel coupled to the bottom edge panel along an eighth fold line, to the first panel along a ninth fold line, and to the second panel along a tenth fold line, wherein the sheet is further configured such that when the sheet folds along the fold lines, the second pocket panel folds between the interior surface of the first panel and the interior surface of the second panel to form a second pocket with a second lip defined by a portion of the front edge panel adjacent the bottom edge panel.

14. The blank sheet of material of claim 13, further comprising:

a first tab coupled to the top edge panel along an eleventh fold line, wherein the sheet is configured such that when the sheet folds along the fold lines, the first tab extends along the interior surface of the second panel and is attached thereto.

15. The blank sheet of material of claim 14, further comprising:

a second tab coupled to the rear edge panel along a twelfth fold line, wherein the sheet is further configured such that when the sheet folds along the fold lines, the second tab extends along the interior surface of the second panel.

16. The blank sheet of material of claim 15, further comprising:

a third tab coupled to the front edge panel along a thirteenth fold line, wherein the sheet is further configured such that when the sheet folds along the fold lines, the third tab extends along the interior surface of the second panel.

17. A single blank sheet of material for forming a package, the blank sheet of material comprising:

a first panel and a second panel coupled to each other by a bottom edge panel;

a first fold line disposed between the first panel and the bottom edge panel;

a second fold line disposed between the bottom edge panel and the second panel;

a top edge panel coupled to the first edge panel along a third fold line;

a rear edge panel coupled to the first panel along a fourth fold line;

a front edge panel coupled to the first panel along a fifth fold line; and a first pocket panel coupled to the top edge panel along a sixth fold line and to the first panel along a seventh fold line, wherein the sheet is configured to fold along the fold lines such that an interior surface of the first panel faces an interior surface of the second panel, the front edge panel, the top edge panel, the rear edge panel and the bottom edge panel each extends between the first panel and the second panel, and the first pocket panel folds between the interior surface of the first panel and the interior surface of the second panel to form a first pocket with a first lip defined by a portion of the front edge panel adjacent the top edge panel, wherein the first pocket panel includes a first pocket tab with a first tab fold line, wherein the first pocket tab is configured to fold along the sixth fold line such that a first portion of the first pocket tab forms an angled surface from the top edge to an interior surface of the front edge panel, and wherein the first pocket tab is configured to fold along the first tab fold line such that a second portion of the first pocket tab extends along the interior surface of the front edge panel towards the bottom edge panel.

18. The blank sheet of material of claim 17, further comprising:

a second pocket panel coupled to the bottom edge panel along an eighth fold line, to the first panel along a ninth fold line, and to the second panel along a tenth fold line, wherein the sheet is further configured such that when the sheet folds along the fold lines, the second pocket panel folds between the interior surface of the first panel and the interior surface of the second panel to form a second pocket with a second lip defined by a portion of the front edge panel adjacent the bottom edge panel.

19. The blank sheet of material of claim 18, further comprising:

a first tab coupled to the top edge panel along an eleventh fold line, wherein the sheet is configured such that when the sheet folds along the fold lines, the first tab extends along the interior surface of the second panel and is attached thereto.

20. The blank sheet of material of claim 19, further comprising:

a second tab coupled to the rear edge panel along a twelfth fold line, wherein the sheet is further configured such that when the sheet folds along the fold lines, the second tab extends along the interior surface of the second panel.

21. The blank sheet of material of claim 20, further comprising:

a third tab coupled to the front edge panel along a thirteenth fold line, wherein the sheet is further configured such that when the sheet folds along the fold lines, the third tab extends along the interior surface of the second panel.

* * * * *